US008032995B2

(12) United States Patent
Metzler et al.

(10) Patent No.: US 8,032,995 B2
(45) Date of Patent: Oct. 11, 2011

(54) DEVICE FOR SEPARATING THREADS FROM A LAYER OF THREADS, METHOD FOR OPERATING THE DEVICE AND USE OF THE DEVICE

(75) Inventors: Paul Metzler, Jona (CH); Martin Hunziker, Maienfeld (CH)

(73) Assignee: Staubli AG Pfaffikon, Pfaffikon (CH)

( * ) Notice: Subject to any disclaimer, the term of this patent is extended or adjusted under 35 U.S.C. 154(b) by 186 days.

(21) Appl. No.: 12/304,319

(22) PCT Filed: Jun. 21, 2007

(86) PCT No.: PCT/CH2007/000309

§ 371 (c)(1),
(2), (4) Date: Oct. 6, 2009

(87) PCT Pub. No.: WO2007/147282

PCT Pub. Date: Dec. 27, 2007

(65) Prior Publication Data

US 2010/0031484 A1 Feb. 11, 2010

(30) Foreign Application Priority Data

Jun. 23, 2006 (EP) ..... 06405270

(51) Int. Cl.
*D03J 1/00* (2006.01)
*B65H 51/005* (2006.01)

(52) U.S. Cl. ..... 28/202; 28/172.1

(58) Field of Classification Search ..... 28/202, 28/172.1, 198, 208, 185, 186, 203.1, 172.2, 28/184, 187, 205, 190, 193; 139/35, 97, 139/353; 57/22, 23

See application file for complete search history.

(56) References Cited

U.S. PATENT DOCUMENTS 2,690,606 A * 10/1954 Fleischer ..... 28/202
3,136,025 A * 6/1964 Noone et al. ..... 28/202
4,164,805 A * 8/1979 Altenweger ..... 28/202

(Continued)

FOREIGN PATENT DOCUMENTS

EP 0206196 A 12/1986

(Continued)

OTHER PUBLICATIONS

International Search Report dated Oct. 24, 2007.

*Primary Examiner* — Amy Vanatta
(74) *Attorney, Agent, or Firm* — Perman & Green, LLP

(57) ABSTRACT

The device is used for separating a partial quantity of threads from a thread layer by means of a movable separating means, wherein the thread layer is formed from a plurality of adjacently arranged threads. The device includes a movement device for moving the separating means relative to the thread layer, a control device for controlling the movement device and a detection device for detecting threads, wherein the detection device allows the detection of a reference position relative to the thread layer and the movement device can be controlled in such a manner that the separating means can be brought to a working position relative to the thread layer and can execute a separating movement in which the separating means is at least partially inserted between two adjacent threads. At least one relative coordinate of the working position in relation to the reference position is a variable parameter of the control device and at least one value for this relative coordinate can be made available to the control device.

18 Claims, 6 Drawing Sheets

U.S. PATENT DOCUMENTS 4,545,099 A * 10/1985 Tovenrath et al. ..... 28/202
4,805,276 A * 2/1989 Plaschy ..... 28/187
5,003,675 A * 4/1991 Esser et al. ..... 28/141
5,099,555 A * 3/1992 Okuda ..... 28/172.1
5,174,000 A * 12/1992 Wilhelm et al. ..... 28/205
5,184,380 A * 2/1993 Benz et al. ..... 28/205
5,251,673 A * 10/1993 Adachi et al. ..... 139/370.1
5,940,945 A * 8/1999 Bommer et al. ..... 28/198
7,356,893 B2 * 4/2008 Bachmann ..... 28/198
2005/0028335 A1 2/2005 Bachmann

FOREIGN PATENT DOCUMENTS

EP 0388880 A 9/1990
WO 02088445 A 11/2002

* cited by examiner

DEVICE FOR SEPARATING THREADS FROM A LAYER OF THREADS, METHOD FOR OPERATING THE DEVICE AND USE OF THE DEVICE

CROSS REFERENCE TO RELATED APPLICATIONS

This application is the National Stage of International Application No. PCT/CH2007/000309 International Filing Date, 21 Jun. 2007, which designated the United States of America, and which International Application was published under PCT Article 21 (2) as WO Publication No. WO2007/147282 and which claims priority from European Application No. 06405270.7, filed on 23 Jun. 2006, the disclosures of which are incorporated herein by reference in their entireties.

BACKGROUND

1. Field

The disclosed embodiments relate to a device for separating a partial quantity of threads from a layer of threads with a movable separating means, a method for operating the device and a use of the device.

2. Brief Description of Related Developments

In many industrial processes based on the processing of threads (e.g. method for producing fabrics, textiles, etc.), the handling of thread layers consisting of a plurality of adjacently arranged, for example, parallel, threads plays a central role.

For example, the warp threads of a warp such as are processed on weaving machines are generally arranged more or less closely adjacent to one another and thus form a mostly flat (warp) thread layer. In this case, more or less large gaps are usually formed between neighbouring threads of the thread layer, the size of these gaps being related on the one hand to the yarn count (diameter) of the threads used, their condition such as hairiness, for example, and on the other hand, to the degree of fineness, the weight or the density which the fabric to be produced from the thread layer should have.

An elementary process step for handling a thread layer is the separation of threads from the thread layer. In this process step, a single thread or a partial quantity having a predefined number of threads is grasped and parted or separated from the remaining threads of the thread layer to allow individual further treatment of the respectively separated threads (independently of the remaining threads in the thread layer). By repeatedly applying the process step, all the threads of the thread layer can be successively separated and each subjected to further individual treatment.

The aforesaid concepts for processes for separating threads from a thread layer have found a number of applications in industrial production.

A typical application relates, for example, to the preparation of a weaving machine for the production of fabrics, where usually a plurality of (warp) threads must be drawn individually through various openings provided in the loom harness (for example, the opening for the thread eyelet in a heald). For this purpose, in each case the thread instantaneously forming the edge on a predefined side of the thread layer is usually separated from a prepared thread layer and then threaded through an opening assigned to this thread in the loom harness and this process is repeated until all the threads of the thread layer have been processed.

Another typical application relates, for example, to tying machines which have the task of tying threads of a first thread layer to threads of a second thread layer (for example, by means of knotting) to join the first thread layer to the second thread layer. For this purpose, a tying machine usually separates respectively one thread at the edge of the first thread layer and one thread at the edge of the second thread layer, ties one end of the one separated thread to one end of the other separated thread and repeats this process until each thread of the first thread layer is joined to each thread of the second thread layer.

In devices for separating threads from a thread layer, an important requirement is that the number of threads separated in a single work step should be monitored exactly: should the number of threads separated in one work step differ from a predetermined desired number, uncontrolled irregularities can then occur in subsequent work steps which can lead to reduced quality of the products to be produced and possibly to unusable products.

EP0206196 discloses a device for separating a single thread from a thread layer by means of a movable separating means. The separating means of this device is configured as a so-called separation needle which comprises a needle tip and a notch disposed on a side flank of the needle tip. For separating a thread at the edge, the needle tip is brought in contact with the thread to be separated and moved in its longitudinal direction until the thread to be separated is gripped by the notch, in which case the separation needle in the area of the notch is at least partly inserted into a gap between the thread to be separated and an adjacent thread. During a further movement of the separation needle, the thread grasped by the notch is separated from the remaining threads of the thread layer. In order to ensure that the separation needle always grasps and separates precisely one thread, the shape of the notch must be adapted to the cross-sectional shape of the thread to be separated within narrow tolerances. Otherwise, there is a risk either that no thread will be grasped by the respective notch and separated or that a plurality of threads will be grasped and separated. Accordingly, the device must be fitted with various separation needles in order to be able to process threads of different thickness, which must optionally be exchanged when threads of different diameters are to be processed. Exchanging the separation needles is usually time-consuming. In addition, fitting the device with plurality of separation needles covering a particular range of yarn counts is costly. Another disadvantage can be seen in that even the manufacture of a single separation needle can be associated with high costs if the notch of the respective separation needle needs to be fabricated with high precision. The latter particularly applies to separation needles which are provided for separating relatively thin threads.

SUMMARY

The aspects of the disclosed embodiments are aimed to avoid said disadvantages and provide a device for separating a partial quantity of threads from a thread layer with a movable separating means which simplifies the handling of threads having different yarn counts. Furthermore, a method for operating the device and uses of the device should be specified.

The device for separating a partial quantity of threads from a thread layer according to the disclosed embodiments comprises a movable separating means, a movement device for moving the separating means relative to the thread layer, a control device for controlling the movement device and a detection device for detecting threads.

In this case, it is assumed that the thread layer is formed from a plurality of adjacently arranged threads and the partial quantity consists of one or more threads of the thread layer arranged at one edge of the thread layer, that the detection device allows the detection of a reference position relative to the thread layer and that the movement device can be controlled in such a manner (by moving the separating means and/or the thread layer) that the separating means can be brought to a working position relative to the thread layer and can execute a separating movement in which the separating means is at least partially inserted between two adjacent threads.

According to the disclosed embodiments, it is provided that at least one relative coordinate of the working position in relation to the reference position is a variable parameter of the control device and at least one value for this relative coordinate can be made available to the control device.

According to the disclosed embodiments, a single separating means is accordingly used for separating threads. For separating one thread having a predefined (arbitrarily large) thread diameter, merely one working position of the separating means must be suitably selected in relation to a predefined reference position, the separating means optionally brought to this position and the separating movement of the separating means then executed. The relative spatial position of the respective working position in relation to the reference position can be varied in each case within a predefined framework and suitably selected before the separation, depending on the diameter of the threads to be separated.

For this purpose, for example, a value can be provided for the relative coordinate of the working position, the respectively provided value can be made available to the control device for controlling the movement device and the movement device can be controlled in such a manner that the separating means is optionally moved to the working position corresponding to the provided value and executes the separating movement.

Since the relative coordinate of the working position is a variable parameter of the control device, various working positions in relation to a predefined reference position can be reached by suitably predefining the respective relative coordinates and threads with various thread thicknesses can thereby be separated using the same separating means in each case. Thus, exchanging the separating means can be omitted.

Any spatial coordinate which defines the spatial position of the thread layer or an edge of the thread layer or the respective threads to be separated is suitable as the reference position. For example, a specific location on one edge of the thread layer or on one specific thread of the thread layer or at a predetermined distance from the thread layer or from a specific thread of the thread layer can be provided as reference position. Before separation, the respective reference position is determined in each case according to a predefined criterion and then a relative coordinate is determined which defines the working position of the separating means in relation to the reference position.

In this connection, "relative coordinate" is understood as any information which characterises the position of the working position relative to the reference position. Depending on the number of degrees of freedom which movements of the separating means can have, it can also be appropriate to specify the respective working position by a plurality of relative coordinates.

According to the disclosed embodiments, the detection device merely needs to register a reference position in relation to the thread layer using measuring technology means within predefined tolerances. Since the respective working position is fixed by defining one or more relative coordinates in each case relative to the reference position, it is not necessary for the detection device to be able to identify the position on the thread layer at which the separating means must impinge upon the thread layer in order to reliably separate a predefined number of threads without damaging the threads (i.e., the detection device need not be designed to directly identify the respective working position).

The latter is advantageous particularly with regard to the requirements which the detection device must satisfy. For example, the detection need not be able to distinguish, for example, neighbouring threads within the thread layer. The latter therefore simplifies the handling of thread layers in which threads lie adjacent to one another without gaps or at a short distance and/or the handling of adjacent threads which are difficult to distinguish for other reasons (for example, threads which are of the same colour, very hairy and/or of small diameter and/or slub threads).

In one embodiment, the relative coordinate is a distance between the working position and the reference position. This manner of specifying the working position can be implemented using simple means and, for example, is particularly well suited if the movement device moves the separating means exclusively with rectilinear (linear) movements to the respective working position.

In another embodiment, the control device is designed so that the value for the relative coordinate can be determined by the control device as a function of a yarn count of at least one of the threads and/or as a function of the average of the yarn counts of a plurality of threads and/or as a function of a predefined number of threads to be separated. In this case, values for the respective yarn counts or for the number of threads to be separated are predefined for the control device. Such a design of the control device simplifies the separation of threads having different diameters and allows for varying the number of threads to be separated upon executing a separating movement.

Another embodiment comprises a measuring device for determining the respective yarn count and/or the average of the respective yarn counts. As a result, the device according to the disclosed embodiments is capable of automatically determining the relative coordinates of the respective working position for each thread layer to be processed. This measure increases the degree of automation and simplifies the operation of the device.

Another embodiment additionally comprises a monitoring device for monitoring the number of the threads which have been separated from the thread layer after executing a separating movement. The monitoring device makes it possible to determine whether at least one thread has been separated and if so, whether optionally a plurality of threads, for example, a double thread (i.e. two adjacent threads) have been separated.

In a further development of the aforesaid embodiments, it is provided to determine experimentally the yarn count of each of the threads of the thread layer before the separation using the movement device and the aforesaid monitoring device. For this purpose, the relative coordinate of a working position is selected, for example, by probing, e.g. by executing the separating movement at various working positions with respectively different relative coordinates, in such a manner that one or a plurality of threads are separated when the separating means is brought to this working position and then the separating movement is executed. After executing the separating movement, the number of separated threads is determined and the respective yarn count or the average of the yarn counts of the respectively separated threads is determined from the selected relative coordinate of the working position and the determined number of separated threads.

In a further embodiment it is provided that the detection device comprises a device for non-contact detection of threads. The mechanical stressing of the threads is thereby kept low and undesirable accompanying effects of mechanical stressing (for example, wear or abrasion of threads) are reduced.

Non-contact detection of threads can be implemented, for example, using optical means.

One embodiment of the detection device comprises, for example, a first optical system for generating a first image of the thread, a first light-sensitive detector for registering the first image and an image processing system. The image processing system can be used to evaluate signals from the first light-sensitive detector and/or for processing the first image. The image processing system is used, for example, to determine the respective reference position. The image processing system can also be used to determine or estimate the number of threads which were actually separated after executing the separating movement. For this purpose, images of the threads can be recorded by the first optical system in each case before executing a separating movement and after executing the separating movement. By comparing the images it can be checked whether at least one thread has been separated or not after executing the separating movement. If the evaluation of the images reveals that at least one thread has been separated, by a more accurate evaluation of the images it can be investigated whether a plurality of threads have possibly been separated. Accordingly, this evaluation also makes it possible to implement the function of the aforesaid monitoring device. However, this evaluation can be limited if a plurality of separated threads lie one above the other (in the direction of the optical image of the optical system) so that they cannot be distinguished when evaluating the images using the image processing system. In this case, it can possibly not be distinguished whether a single thread has been separated or several threads (for example, a double thread) have been separated.

An improved design variant compared with the aforesaid detection device comprises, in addition to said first optical system and said first light-sensitive detector, a second optical system for generating a second image of the threads and a second light-sensitive detector for registering the second image, wherein the first and the second image represent the respective threads from different perspectives and an image processing system is provided to evaluate the two images. A comparison of the first and the second image provides information on the instantaneous arrangement of the threads in three spatial dimensions (provided that the two images represent the threads at the same time). This (quasi-) three-dimensional representation of the threads has the advantage that it is easier to detect double threads. In this way, the number of threads which are actually separated when executing the separating movement can be determined with increased reliability. Accordingly, this design variant also represents a realisation of the function of the aforesaid monitoring device.

The devices according to the disclosed embodiments can be used for separating threads, for example, in a textile machine, in particular a tying machine or a drawing-in machine or a leasing machine.

BRIEF DESCRIPTION OF THE DRAWINGS

Further details of the disclosed embodiments and in particular, exemplary embodiments of the device according to the disclosed embodiments and the method according to the disclosed embodiments are explained hereinafter with reference to the appended schematic drawings. In the figures.

DETAILED DESCRIPTION OF THE DISCLOSED EMBODIMENTS

Figure 1:
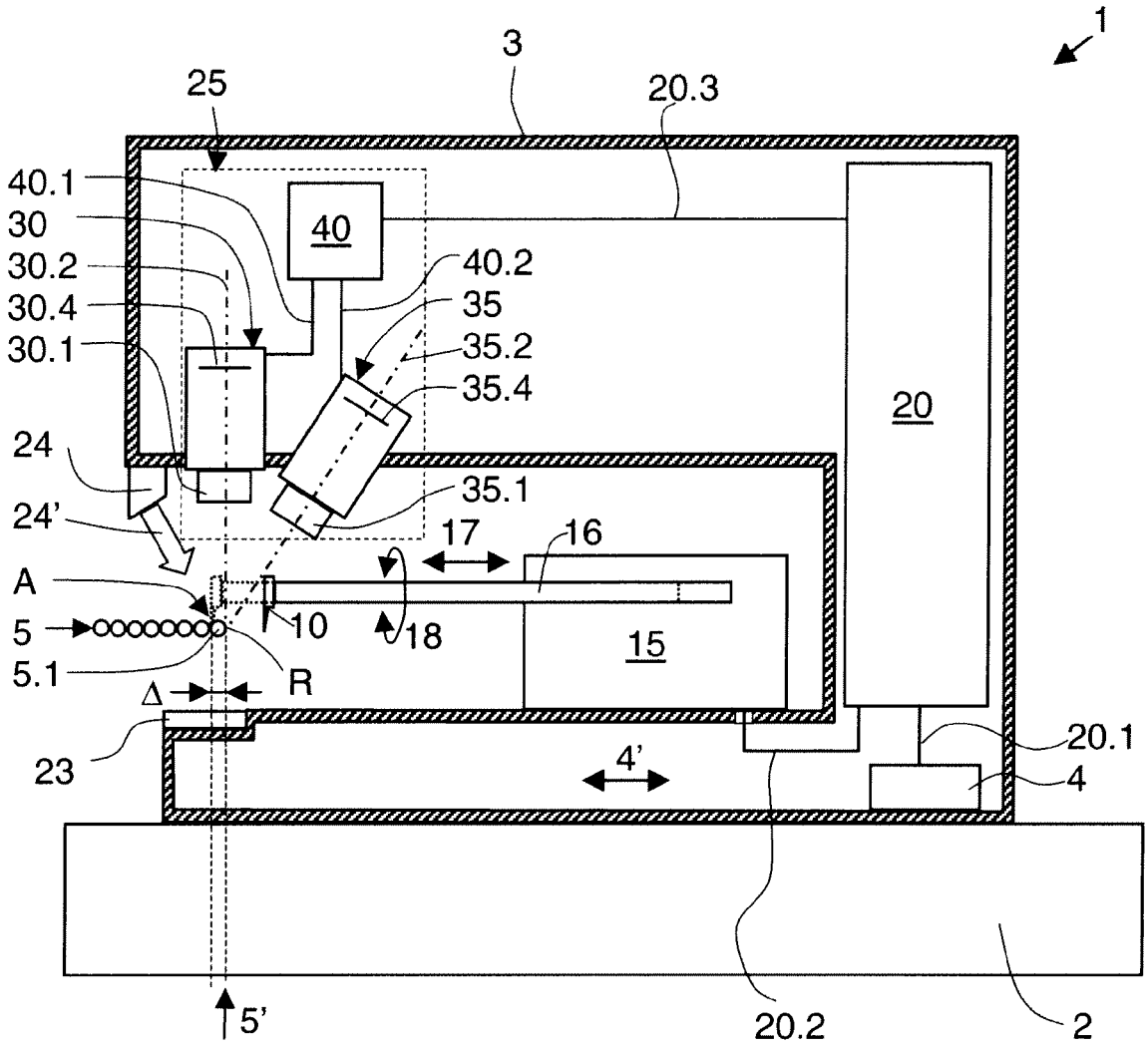
FIG. 1 is a device according to the disclosed embodiments for separating threads from a thread layer using a movable separating means, a movement device for moving the separating means relative to the thread layer, a control device for controlling the movement device and a detection device for detecting threads.

FIG. 1 shows (schematically) a device 1 for separating a partial quantity of threads from a thread layer.

In the present case, the device 1 is ready for processing a thread layer 5. It is assumed that the thread layer 5 consists of a plurality of threads which are arranged parallel to one another within a plane (where the threads can optionally be held using conventional means). The direction of the longitudinal extension of the threads is perpendicular to the plane of the drawing in FIG. 1. The threads are each shown in one cross-section.

The device 1 comprises a base portion 2 and an upper portion 3 arranged on said base portion 2. In the present case, the base portion 2 is arranged in a fixed position. The upper portion 3 is movable relative to the base portion 2 so that the upper portion 3 can be positioned relative to the thread layer 5.

The device 1 further comprises a drive 4 for positioning the upper portion 3 relative to the base portion 2 or the thread layer 5. The upper portion 3 can be moved forwards and backwards in particular, parallel to the thread layer 5 and perpendicular to the respective threads of the thread layer 5, as is indicated by a double arrow designed by 4' in FIG. 1.

Within the scope of the disclosed embodiments, an equivalent alternative to arrange the thread layer 5 movably relative to the upper portion 3 would naturally also be possible.

The upper portion 3 is configured as a support for a plurality of components which can be positioned in relation to the thread layer 5 by moving the upper portion 3. These components include:

a separating means 10, a movement device 15 for moving the separating means 10 (relative to the upper portion 3) and a detection device 25 for detecting threads of the thread layer 5.

The movement device 15 and/or the drive 4 implement (each considered per se or in conjunction with one another) a movement device for moving the separating means 10 relative to the thread layer 5.

In addition, a control device 20 is accommodated in the upper portion 3. The control device 20 is provided, among other things, for controlling the drive 4, the movement device 15 and the detection device 25 and is configured for this purpose to communicate with the drive 4 via a connection 20.1, with the movement device 15 via a connection 20.2 and with the detection device 25 via a connection 20.3.

The control device is preferably implemented using electronic means. The connections 20.1, 20.2 and 20.3 are communication lines of the usual type and can accordingly be implemented using various technologies (for example, via connecting lines or in wireless mode).

The movement device 15 comprises a movable, straight arm 16 having the separating means 10 affixed at one end. The movement device makes it possible to move the separating means 10 with at least two degrees of freedom (hereinafter called "degrees of freedom of movement"): the movement device is designed such that the arm 16, controlled by the control device 20, can be moved forwards and backwards in its longitudinal direction on the one hand (within the scope of a first degree of freedom of movement which is indicated by an arrow or double arrow 17 in FIGS. 1-6) and on the other hand, can be rotated about its longitudinal direction (within the scope of a second degree of freedom of movement which is indicated by an arrow or double arrow 18 in FIGS. 1-6).

The movement device 15 has a linear guide (not shown in the figures) for the arm 16 or the separating means 10 for implementing the first degree of freedom of movement and for implementing the second degree of freedom of movement, a rotary mounting (not shown in the figures) which allows the arm 16 or the separating means 10 to rotate about an axis of rotation of the rotary mounting.

A method whereby said degrees of freedom of movement can be used for separating threads from the thread layer 5 is explained further below among other things in connection with FIGS. 2-6.

The detection device 25 is configured to detect threads of the thread layer 5 and comprises for this purpose:

a first camera 30 with a first optical system 30.1 for producing a first image of the threads of the thread layer 5 and a first light-sensitive detector 30.4 for registering the first image, where this first image shows the thread layer 5 or a part of the thread layer 5 from a first perspective along an optic axis 30.2 of the first optical system 30.1, a second camera 35 with a second optical system 35.1 for producing a second image of the threads of the thread layer 5 and a second light-sensitive detector 35.4 for registering the second image, where this second image shows the thread layer 5 or a part of the thread layer 5 from a second perspective along an optic axis 35.2 of the second optical system 35.1, and an image processing system 40 which is intended for processing the first and the second image.

The image processing system 40 is controlled by the control device 20 and is configured for this purpose to exchange corresponding control signals with the control device 20 via the connection 20.3.

The first camera 30 is electronically controlled and connected to the image processing system 40 via a connection 40.1 to exchange control signals and signals from the first light-sensitive detector 30.4 or data representing the first image with the image processing system 40.

Accordingly, the second camera 35 is electronically controlled and connected to the image processing system 40 via a connection 40.2 to exchange control signals and signals from the second light-sensitive detector 35.4 or data representing the second image with the image processing system 40.

The first optical system 30.1 allows visual inspection of the thread layer 5 or the surroundings of the thread layer 5 within a solid angle 30.3 (see FIGS. 2-6) in the surroundings of the optic axis 30.2 whereas the second optical system 35.1 ensures visual inspection of the thread layer 5 or the surroundings of the thread layer 5 within a solid angle 35.3 (see FIGS. 2-6) in the surroundings of the optic axis 35.2.

As shown in FIG. 1, the optic axes 30.2 and 35.2 are not parallel, rather they intersect at an angle which could in principle be arbitrarily selected in an angular range between 0° and 180° and in the present example is around 45° . The respective perspectives from which the first image and the second image each show the thread layer 5 are accordingly different.

In order to allow a visual inspection of the thread layer 5 with the camera 30 or the camera 35 under defined conditions, illumination of the thread layer 5 is provided by means of a light source 23 to illuminate the side facing away from the cameras 30 and 35 (i.e. for inspection using transmitted light) and a light source 24 to illuminate the thread layer 5 on the side facing the cameras 30 and 35 (i.e., for inspection using incident light) (the light emanating from the light source 24 is indicated by an arrow 24' in FIG. 1). The light sources 23 and 24 are each secured to the upper portion 3 and aligned onto the thread layer 5. The light source 23 is primarily used to detect double threads or a reference position at the edge of the thread layer 5, the light source 24 is used for detecting colours.

In the present case, the optic axis 30.2 of the first optical system 30.1 is aligned perpendicular to the plane spanning the thread layer 5. This alignment of the optic axis 30.2 is arbitrary but appropriate in this connection since the upper portion 3 is assumed to be movable parallel to the thread layer 5 and under the present conditions, the positioning of the upper portion 3 in relation to the thread layer 5 and the sequence of a separation of threads can be monitored relatively simply (i.e. at relatively low expense) exclusively using the first camera 30 or the first optical system 30.1.

The device 1 is provided to separate a predefined number of threads from the thread layer 5 at one edge 5' (see FIGS. 1-4) of the thread layer 5 using separating means 10.

According to the disclosed embodiments, initially one reference position with respect to the thread layer 5 is defined prior to the separation and one working position of the separating means 10 is determined with respect to the respective reference position.

In the example according to FIG. 1, it is provided that before the separation the upper portion 3 is positioned with respect to the thread layer 5 such that (by suitably controlling the drive 4 by means of the control device 20) the optic axis 30.2 is tangent to the thread layer 5 at the threads 5.1 forming the edge 5' (in FIG. 1 the edge 5' of the thread layer 5 is marked by an arrow designated by 5'). The respective positioning of the upper portion 3 with respect to the thread layer 5 can be monitored by means of the first camera 30: the respective first image of the thread layer 5 generated by the first optical system 30.1 is analysed by the image processing system 40 whilst being monitored by the control device 20 in order to determine whether the upper portion is already positioned, as desired, so that the optic axis 30.2 is tangent to the thread layer 5 at the thread 5.1 forming the edge 5'; otherwise, the control device 20 controls the drive 4 such that the upper portion 3 is brought into the desired position. The upper portion 3 can thus be reproducibly positioned with respect to the thread layer 5.

In the present example, the point at which the optic axis 30.2 is tangent to the thread layer 5 at the edge 5' or at the thread 5.1 defines a reference position R on the thread layer 5 with respect to which the respective spatial position of the separating means 10 can be determined.

The reference position R is accordingly detected by the detection device 25 (as described hereinbefore by an evaluation of the first image using the image processing system 40).

In an alternative for determining the reference position R, the upper portion 3 need not be positioned such that the optic axis 30.2 is tangent to the thread layer 5 at the edge 5'. Merely the spatial arrangement of the thread layer 5 relative to the optical system 30.1 or the optic axis 30.2 is registered by measurement techniques. The reference position R can, for example, be the point on the thread layer 5 having the shortest distance from the optic axis 30.2. This reference position R can be determined by evaluating the first image of the thread layer 5 generated using the first optical system 30.1 (preferably using transmitted light) using the image processing system 40. This can be accomplished with an accuracy which is determined by the spatial resolution of the first optical system 30.1, the first light-sensitive detector 30.4 and the image processing system 40. The reference position R can be characterised, for example, by specifying its distance from the optic axis 30.2 or specifying corresponding spatial coordinates. In this case, it is not necessary to position the upper portion 3 highly accurately relative to the thread layer 5 or to arrange or align the optic axis 30.2 precisely relative to the thread layer 5 before each separating movement is executed (it is sufficient to register the reference position R or surroundings of the reference position R by means of the first optical system 30.1 or the image processing system 40 and determine the reference position with the desired accuracy).

A working position A of the separating means 10 is specified by specifying a relative coordinate with respect to the reference position R: the relative coordinate is appropriately the distance Δ between the edge 5' and the working position A. The respective distance Δ is achieved in each case by suitable positioning of the arm 16, optionally by a movement of the arm 16 in the longitudinal direction of the arm 16 (i.e. in the direction of the arrow or double arrow 17 in FIGS. 1-6).

The respective working position A is determined such that during a rotation of the arm 16 about its longitudinal direction (i.e. in the direction of the arrow or double arrow 18), the separating means 10 is inserted between the thread to be separated in each case and an adjacent thread. FIG. 1 shows the separating means 10 and the arm 16 in a working position A which is suitable as a starting position for a separation of a single thread, i.e. the thread 5.1 (the separating means 10 and the arm 16 are shown in the corresponding position by dashed lines).

In order to ensure reliable positioning of the separating means 10 relative to the thread layer 5, the respective position of the separating means 10 relative to the upper portion 3 or relative to the optic axis 30.2 of the control device 20 must be known or made known. The data required to determine the position of the separating means 10 can be made available to the control device 20 during system initialisation or system configuration (for example, during commissioning of the device 1).

A method for operating the device 1 for separating a partial quantity of threads from the thread layer 5 is explained hereinafter with reference to FIGS. 2-6. The method is discussed as an example for the case where only the thread 5.1 at the edge 5' of the thread layer 5 is to be separated from the remaining threads of the thread layer 5.

Figure 2:
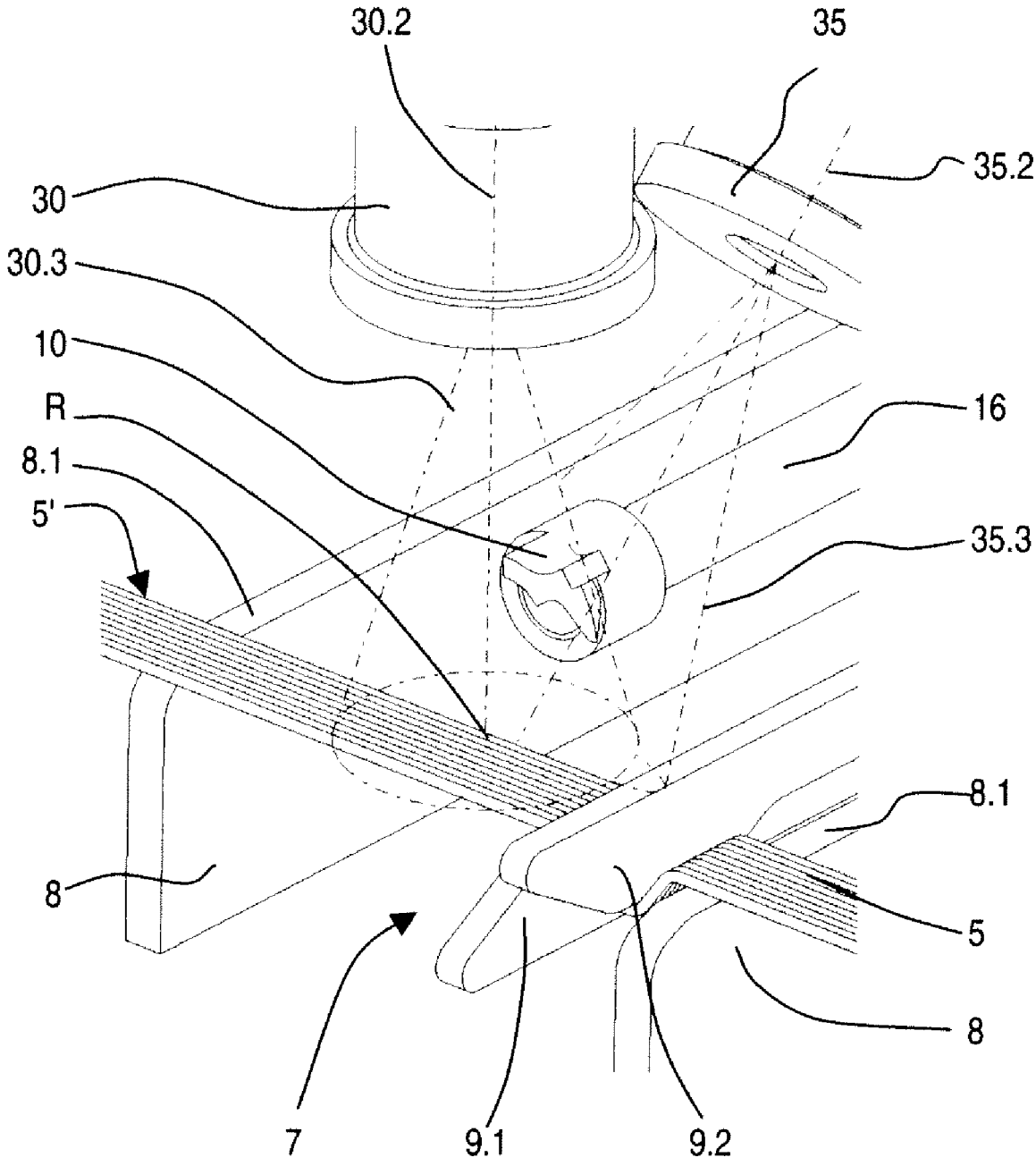
FIGS. 2-6: each show a part of the device according to FIG. 1, wherein the separating means is shown in various positions which said separating means successively adopts when separating threads.

FIG. 2 shows the device 1 in a state which can serve as a starting point for carrying out the method for separating a thread at the edge 5'. The upper portion 3 is positioned under the control of the control device 20 such that the optic axis 30.2 is approximately tangent to the edge 5', the distance between the edge 5' and the optic axis 30.2 being less than a predefined value. The arrangement of the upper portion 3 with respect to the thread layer 5 is verified by means of the detection device 25 (as described above). The point at the edge 5' of the thread layer 5 having the shortest distance from the optic axis 30.2 is considered to be the reference position R hereinafter. The reference point R is detected by the detection device 25 and is thus fixed for the subsequent course of the method.

In the present example, as can be deduced from FIGS. 2-6, the separating means 10 has the form of a pointed wedge and is mounted on one end of the arm 16 such that a pointed end of the separating means 10 projects radially at the periphery of the arm 16.

In the course of the method (see FIGS. 2-6) the position of the arm 16 and therefore the position of the separating means 10 are varied, in which case both the afore-mentioned degrees of freedom of movement of the movement device 15 of the arm 16 are utilised: (i) the first degree of freedom of movement to change the position of the separating means 10 in the longitudinal direction of the arm 16 (i.e., in the direction of the arrows 17) and (ii) the second degree of freedom of movement to rotate the arm 16 or the separating means 10 about the longitudinal direction of the arm 16 (i.e. in the direction of the arrows 18) and thereby change the angular position of the separating means 10 with respect to the axis of rotation.

In the situation according to FIG. 2 (starting point) the separating means 10 is arranged at a predefined starting position remote from the edge 5' of the thread layer 5 and at a distance from the reference position R. The coordinates of the respective position of the separating means 10 (relative to the upper portion 3) are transmitted from the movement device 15 via the connection 20.2 to the control device 20.

Figure 3:
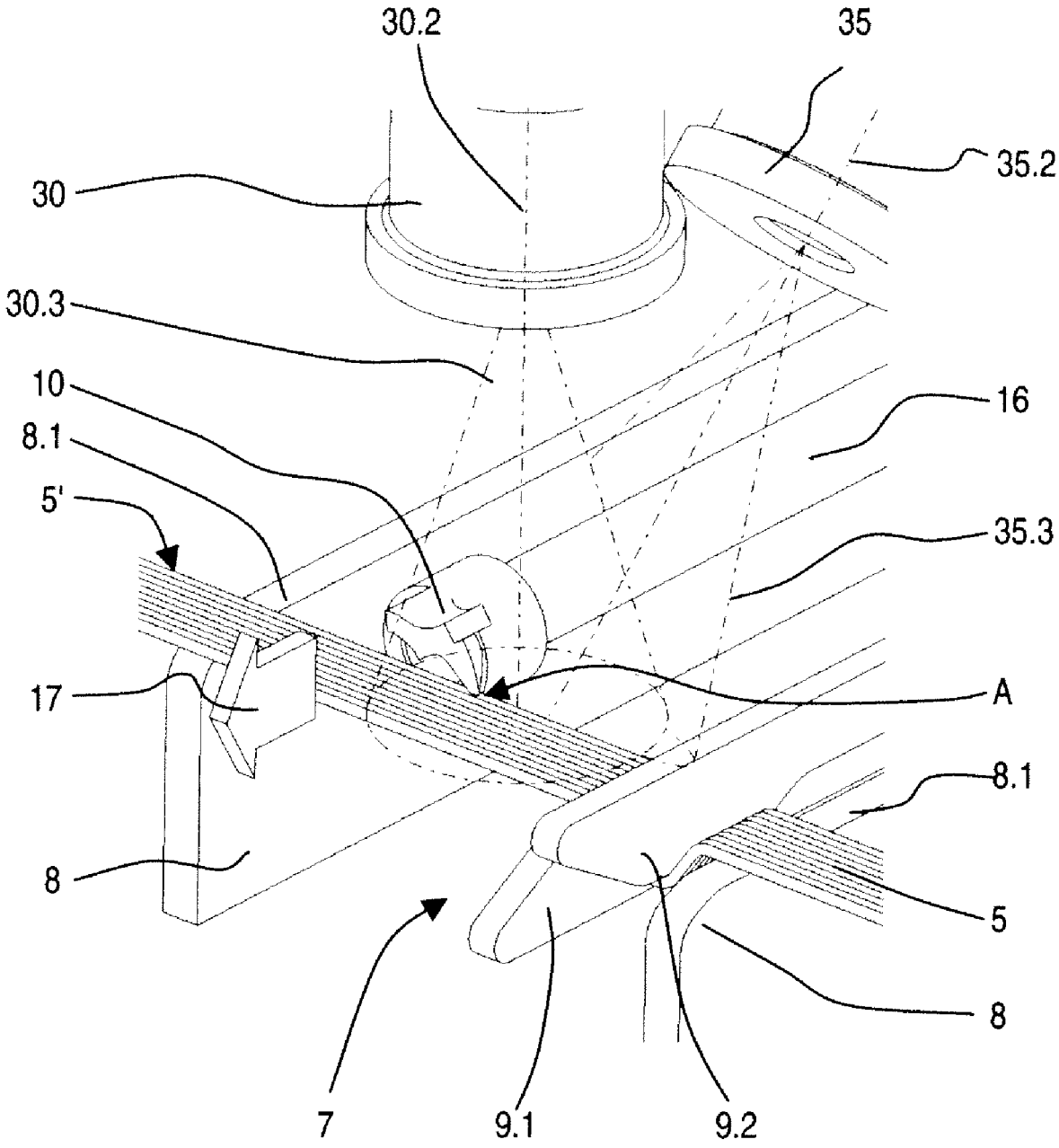

FIG. 3 shows the separating means 10 in a working position A. The separating means 10 was moved (compared to the situation according to FIG. 2) in the direction of the arrow 17 (first degree of freedom of movement) and brought into a position in which the pointed end of the separating means 10 is arranged above the thread layer 5 and from which the pointed end of the separating means 10 can be moved by rotating the arm 16 about its longitudinal direction (second degree of freedom of movement) between the thread 5.1 and the neighbouring thread (separating movement).

In order to bring the separating means 10 into the working position A, a corresponding value is provided for the relative coordinate Δ (distance between the working position A and the reference position R or the edge 5') and supplied to the control device 20 for controlling the movement device 15. The control device 20 accordingly gives the movement device 15 the command to move the separating means 10 from the starting position according to FIG. 2 to the working position A.

Figure 4:
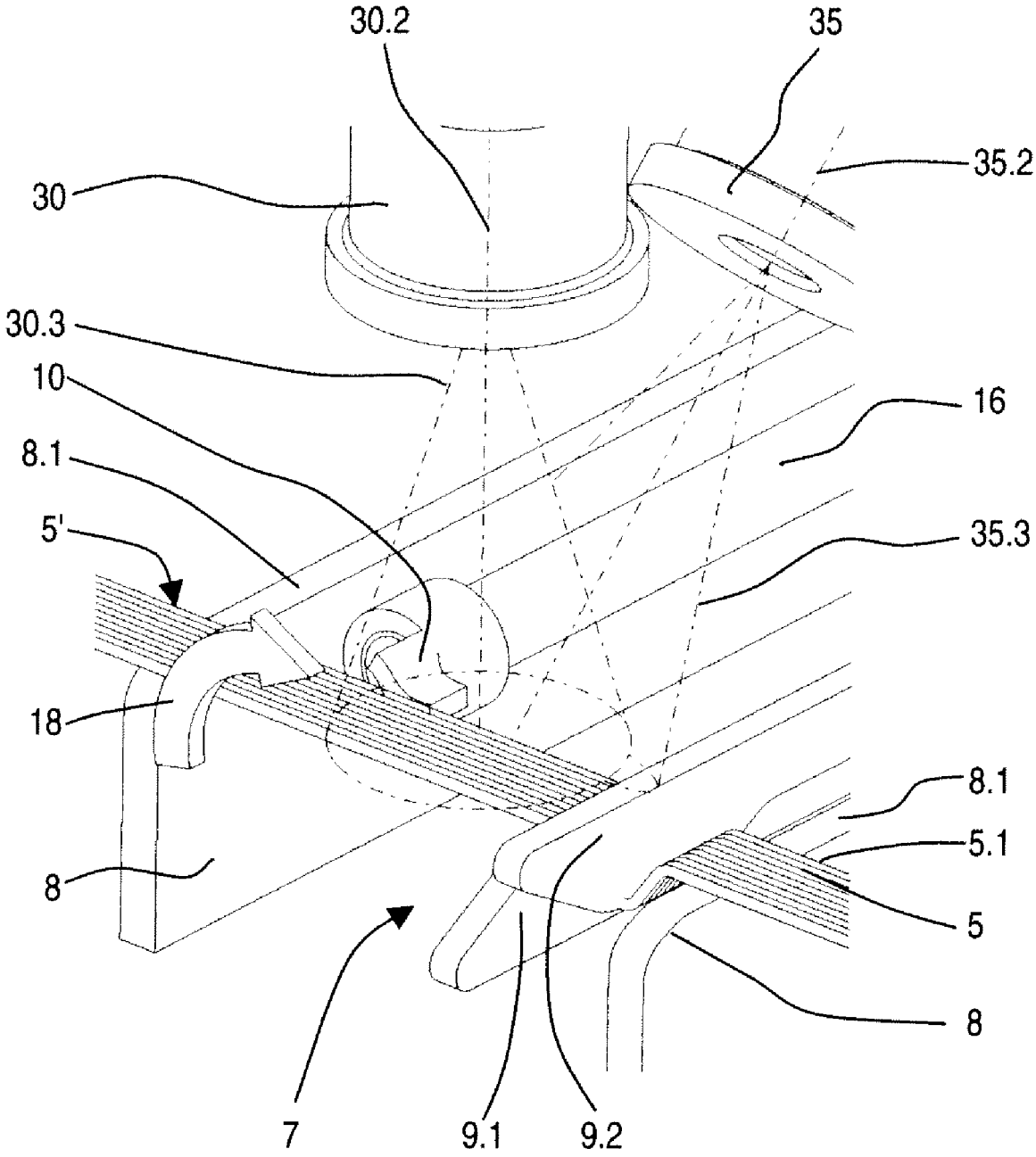

FIG. 4 shows the separating means 10 after said separating means 10 has executed a separating movement by a corresponding control of the movement device 15 (compared to the situation according to FIG. 3), starting from the working position A: the arm 16 was turned in the direction of the arrow 18 about its longitudinal direction (second degree of freedom of movement), whereby the pointed end of the separating means 10 was guided between the thread 5.1 at the edge 5' of the thread layer 5 and the neighbouring thread. After this separating movement, the thread 5.1 is separated by the separating means 10 from the neighbouring thread.

In order to achieve a high reliability during separation, for example, even when threads of the thread layer 5 lie partially one above the other, the device 1 is fitted with a tensioning device 7 which aligns or holds aligned the threads of the thread layer 5 in the proximity of the edge 5' before the separation and/or at least in the initial phase of the separation under defined conditions. The tensioning device 7 comprises two supporting members 8, each supporting member 8 being located underneath the thread layer 5 and having a flat bearing surface 8.1 for the thread layer 5 on its upper side, and two movable arms 9.1 and 9.2. The supporting members 8 are arranged in a fixed position relative to the upper portion 3 and parallel to the thread layer 5 such that the threads of the thread layer 5 lie on the respective bearing surfaces 8.1 of the supporting members 8.

The movable arms 9.1 and 9.2 can be moved within a plane which is arranged perpendicular to the thread layer 5 and perpendicular to the threads of the thread layer 5, relative to the thread layer 5 and relative to the bearing surfaces 8.1, the movable arm 9.1 being located underneath the thread layer 5 and the movable arm 9.2 being located above the thread layer. Prior to separation (FIGS. 2 and 3) and/or in the initial phase of the separation (FIG. 4), the two arms 9.1 and 9.2 are aligned approximately horizontally and arranged close to one another in such a manner that the threads of the thread layer 5 are deflected by the arms 9.1 and 9.2. Furthermore, the threads of the thread layer 5 can be additionally placed under an elevated tensile stress by pressing the thread layer 5 downwards by a suitable positioning of the arms 9.1 and 9.2. This has the result that the thread layer 5 is pressed onto the bearing surfaces 8.1 with an elevated pressing force (see FIGS. 2-4). Said measures have the effect that the threads, when these are deflected by the arms 9.1 and 9.2, lie adjacent to one another within a single layer and are aligned parallel to one another. This can ensure that the threads are not twisted with one another in their longitudinal direction or are not layered one above the other perpendicular to the horizontal plane when the separation is carried out. The separation can thus be carried out under defined, reproducible conditions.

Figure 5:
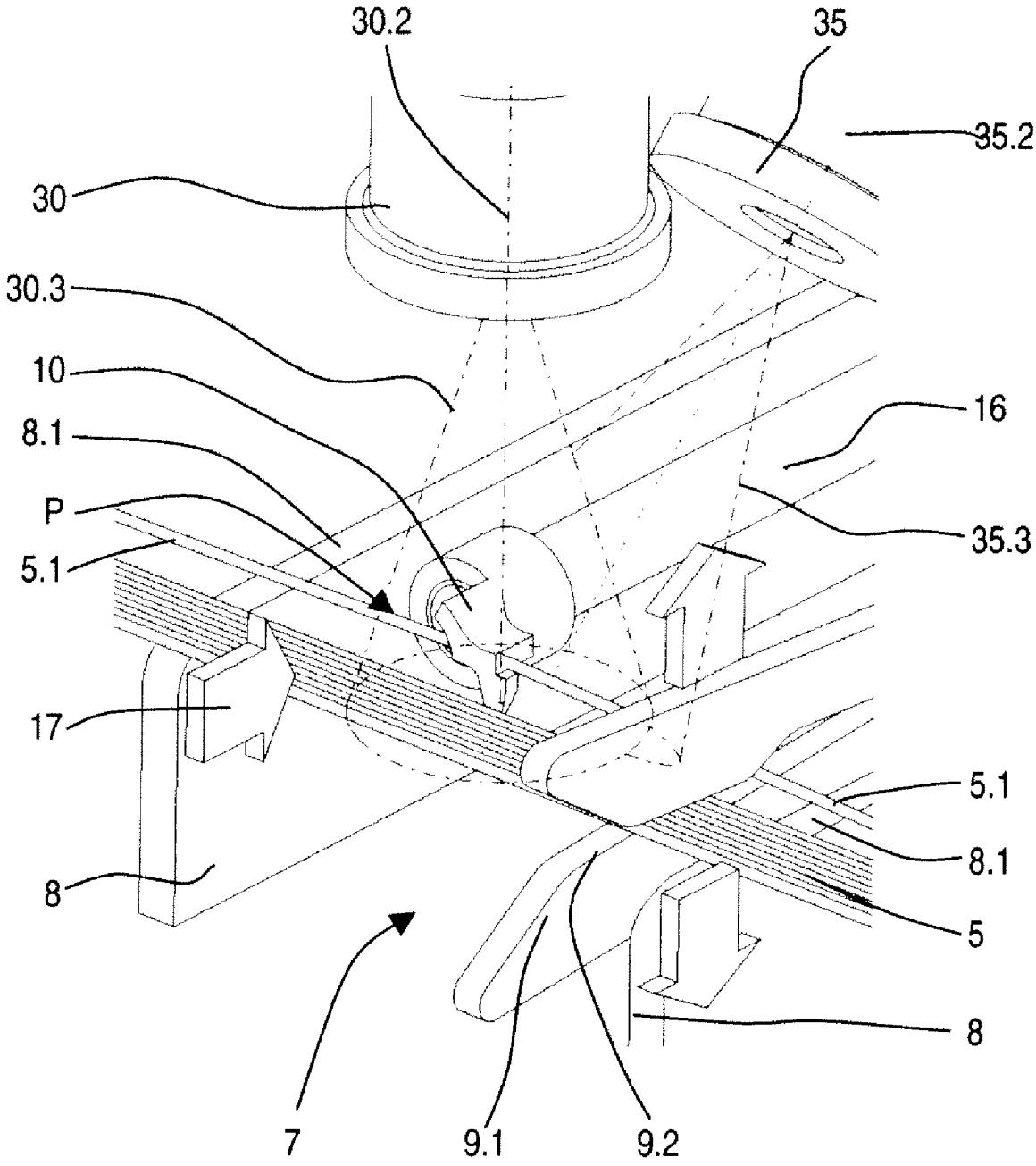
Figure 6:
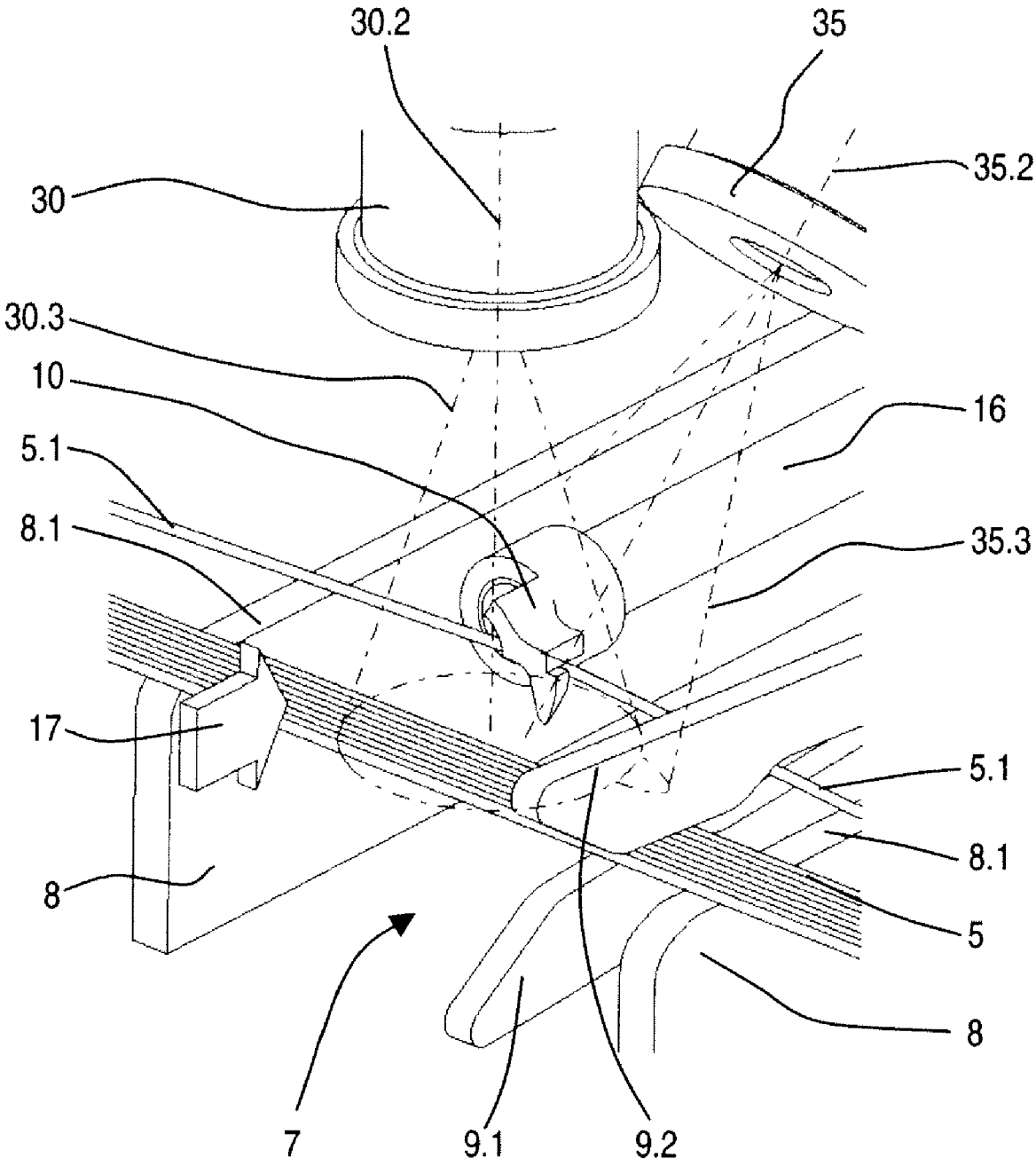

FIG. 5 shows the next step of the method: under the control of the control device 20, the movable arms 9.1 and 9.2 are moved upwards or downwards relative to one another in opposite directions (as indicated by the corresponding arrows in FIG. 5) until the arms 9.1 or 9.2 are no longer in contact with the thread layer 5. The movement device 15 is then triggered such that the arm 16 is moved in its longitudinal direction (first degree of freedom of movement) in the direction of the arrow 17 away from the thread layer 5. In this case, the thread 5.1, which has formed the edge 5' of the thread layer 5 in the situations according to FIG. 2-4, is held by the separating means 10 and likewise moved in the direction of the arrow 17. As a result, a gap which can be clearly identified in FIG. 5, is formed between the thread 5.1 and the remaining threads of the thread layer 5; the thread 5.1 is separated over its entire length from the remaining threads of the thread layer 5.

The thread 5.1 is now located in a "test position" P (FIG. 5). The thread 5.1 initially remains in the test position P for a predetermined time interval. During this time interval it is investigated whether the separating movement in the situation according to FIG. 4 has led to the desired result (i.e. whether a single thread at the edge of the thread layer 5 has been separated in this case). This investigation is carried out using the first camera 30 in conjunction with the image processing system 40 and optionally additionally using the second camera 35. For this purpose, an image of the immediate surroundings of the separating means 10 is produced using the first optical system 30.1 of the first camera 30 and evaluated using the image processing system 40. The evaluation reliably provides (as explained above) information on whether at least one thread has been separated. In order to determine whether one or several threads have been separated, a second image of the immediate surroundings of the separating means 10 can be generated using the second optical system 35.1 of the second camera 35 and evaluated using the image processing system 40. The first and the second image show the surroundings of the separating means 10 from two different perspectives. Consequently, by comparing the first and the second image using the image processing system 40, it is possible to determine (as explained above) the precise number of threads which have been separated when executing the separating movement according to FIG. 4.

If the aforesaid investigation yields the result that fewer threads than desired have been separated when executing the separating movement (i.e. that in the present example, no thread has been separated), this suggests that the distance Δ between the working position A and the reference position R has been selected as too small. In this case, the process steps shown in FIGS. 2-4 can be repeated with a value for the distance Δ increased by a suitable amount.

If the aforesaid investigation yields the result that more threads than desired have been separated when executing the separating movement (i.e. that in the present example, two threads or more than two threads have been separated), this suggests that the distance Δ between the working position A and the reference position R has been selected as too large. In this case, in a continuation of the method, the process steps shown in FIGS. 2-4 must be carried out successively with a value for the distance Δ reduced by a suitable amount.

If the aforesaid investigation yields the result that the desired number of threads have been separated when executing the separating movement, this suggests that the value for the distance Δ between the working position A and the reference position R has been suitably selected. In this case, further processing of the respectively separated threads can be continued, for example, according to FIG. 6: in FIG. 6 the arm 16 is moved in its longitudinal direction (first degree of freedom of movement) in the direction of the arrow 17 and accordingly, the distance between the separated thread 5.1 and the remaining threads of the thread layer 5 is further enlarged using the separating means 10. At this point, the separated thread can be collected by another means, not shown here, for further processing. The aforesaid process steps can then be applied accordingly to the remaining threads of the thread layer 5 until all the threads have been successively separated. In this case, after every separation of a thread, the new coordinates of the reference position R are determined in each case and the new coordinates of the working position A, which the separating means 10 should adopt for separating the next thread, are determined.

Whilst carrying out the process, the control device 20 continuously monitors the spatial position of the thread layer 5 or the respective reference position R with respect to the optic axis 30.2. If the distance of the edge of the thread layer 5 or the reference position R from the optic axis 30.2 exceeds a predefined upper limit, by means of corresponding control commands to be executed by the drive 4, the control device causes the upper portion 3 to be positioned with respect to the thread layer 5 in such a manner that the edge 5' of the thread layer 5 on the first image lies in a predefined region in the proximity of the optic axis 30.2. Said region is selected such that the separation of a predefined minimum number of threads can be monitored with the camera 30 without the upper portion 3 moving again relative to the thread layer 5.

In order to achieve the situation in the examples according to FIGS. 1-6 that the separating means 10 separate a predefined number n of threads of the thread layer 5 by executing a single separating movement according to FIG. 4 (second degree of freedom of movement), the distance Δ between the working position A and the reference position R must be selected as approximately $\Delta \approx nD$ where D is the diameter of the respective threads (assuming that all the threads of the thread layer have the same diameter D). The aforesaid values for Δ must be maintained with an accuracy of about $\pm D/2$.

In order to be able to precisely specify the distance Δ to be maintained, the diameter D must be known as precisely as possible. The device 1 provides several possibilities for automatically determining the diameter D of the threads of the thread layer 5 (under the control of the control device 20):

An image of the thread layer 5 can be produced by means of the first camera 30 or the second camera 35 and evaluated by means of the image processing device 40. If individual threads of the thread layer 5 can be distinguished in said image, the thickness of the respective threads can be determined by a corresponding evaluation of the image. The accuracy of this method can be improved if the threads have a different colour and colour information is taken into account in the image processing: the additional colour information makes it easier to distinguish different threads of different colour from one another. The spatial resolution of the method is thereby improved.

The separating means 10 can optionally be brought to various working positions A at various distances Δ from the reference position R. At each working position A a separating movement of the separating means 10 is triggered and in each case, the number n of threads which are separated in the respective separating movement is determined using the detection device 25 (as described above). The average diameter D of the respective threads can be determined as the quotient Δ/n (for n>0).

The detection device 25 could alternatively (instead of the cameras 30 or 35) be provided with other devices for non-contact detection of threads in order to specify the respective reference position and determine the number of threads which have been separated after executing a separating movement with the separating means: such devices can be implemented, for example, using ultrasound transmitters and ultrasound receivers, where the thread layer 5 and the separated threads are detected using ultrasound. Alternatively, the threads can also be detected using contact-sensitive sensors (for example, pieozelectric sensors or other force sensors).

The invention claimed is:

1. A device for separating a partial quantity of threads from a thread layer by means of a movable separating means, wherein the thread layer is formed from a plurality of adjacently arranged threads and the partial quantity consists of one or more threads of the thread layer arranged at one edge of the thread layer, comprising a movement device for moving the separating means relative to the thread layer, comprising a control device for controlling the movement device and comprising a detection device for detecting threads, wherein the detection device allows the detection of a reference position relative to the thread layer and wherein the movement device can be controlled in such a manner that the separating means can be brought to a working position relative to the thread layer and can execute a separating movement in which the separating means is at least partially inserted between two adjacent threads, wherein at least one relative coordinate of the working position in relation to the reference position is a variable parameter of the control device and at least one value for this relative coordinate can be made available to the control device.

2. The device according to claim 1, wherein a location on one edge of the thread layer or on one thread of the thread layer or at a predetermined distance from the thread layer is provided as reference position.

3. The device according to claim 1, wherein the relative coordinate is a distance between the working position and the reference position.

4. The device according to claim 1, wherein the value for the relative coordinate can be predefined as a function of a yarn count of at least one of the threads and/or as a function of the average of the yarn counts of a plurality of threads of the thread layer and/or as a function of a predefined number of threads to be separated.

5. The device according to claim 1, wherein a monitoring device is provided for monitoring the number of the threads which have been separated from the thread layer after executing the separating movement.

6. The device according to claim 1, wherein the detection device comprises an apparatus for non-contact detection of threads.

7. The device according to claim 6, wherein the apparatus comprises a first optical system for generating a first image of the thread, a first light-sensitive detector for registering the first image and an image processing system for determining the reference position from signals of the first light-sensitive detector.

8. The device according to claim 7, wherein the apparatus comprises a second optical system for generating a second image of the threads and a second light-sensitive detector for registering the second image, wherein the two images represent the respective threads from different perspectives and an image processing system is provided for determining the number of separated threads from signals of the respective light-sensitive detectors.

9. The device according to claim 1, wherein the movement device comprises a first degree of freedom of movement which allows a movement of the separating means relative to the thread layer to the working position and a second degree of freedom of movement which allows execution of the separating movement.

10. The device according to claim 9, wherein the movement device comprises a linear guide for the separating means for implementing the first degree of freedom of movement and a rotary mounting which allows the separating means to rotate about an axis of rotation of the rotary mounting to implement the second degree of freedom of movement.

11. The device according to claim 4, wherein a measuring device is provided to determine the respective yarn count and/or the average of the respective yarn counts.

12. The device according to claim 1, wherein the device is used in a textile machine.

13. A method for operating a device for separating a partial quantity of threads from a thread layer by means of a movable separating means according to any one of claims 1, wherein the thread layer is formed from a plurality of adjacently arranged threads and the partial quantity consists of one or more threads arranged at one edge of the thread layer, and wherein the device comprises:

a movement device for moving the separating means relative to the thread layer, a control device for controlling the movement device a detection device for detecting threads, wherein the detection device allows the detection of a reference position relative to the thread layer and wherein the movement device can be controlled in such a manner that the separating means can be brought to a working position relative to the thread layer and can execute a separating movement in which the separating means is at least partially inserted between two adjacent threads, and wherein at least one relative coordinate of the working position in relation to the reference position is a variable parameter of the control device, which method comprises the following steps:

detecting a reference position relative to the thread layer, providing a value for the relative coordinate of the working position, wherein the value provided in each case is made available to the control device for controlling the movement device, controlling the movement device in such a manner that the separating means occupies the working position corresponding to the provided value and executes the separating movement.

14. The method according to claim 13, wherein a distance between the working position and the reference position is selected as the relative coordinate and a value for this distance is made available to the control device for controlling the movement device.

15. The method according to claim 13, wherein the provided value is determined as a function of a yarn count of at least one of the threads and/or as a function of the average of the yarn counts of a plurality of threads of the thread layer and/or as a function of a predefined number of threads to be separated.

16. The method according to claim 15, wherein the respective yarn count or the average is predefined or measured before separating the partial quantity of threads.

17. The method according to claim 16, wherein an image of one of more threads is produced using an optical system and the respective yarn count of the average is determined by processing the image.

18. The method according to claim 16, wherein the relative coordinate is selected in such a manner that one or more threads are separated by executing the separating movement, the number of separated threads is determined after executing the separating movement and the respective yarn count or the average is determined from the selected relative coordinate and the determined number of separated threads.

* * * * *